US008286953B2

(12) United States Patent
Barnes et al.

(10) Patent No.: US 8,286,953 B2
(45) Date of Patent: Oct. 16, 2012

(54) ARROW FLETCHING DEVICE WITH PLATE CLAMP

(75) Inventors: Mike Barnes, Cadillac, MI (US); Richard F. Mowery, Atlanta, MI (US); Denny M. Leedy, Kalkaska, MI (US); Dale E. Voice, Cadillac, MI (US)

(73) Assignee: The Bohning Company, Ltd, Lake City, MI (US)

( * ) Notice: Subject to any disclaimer, the term of this patent is extended or adjusted under 35 U.S.C. 154(b) by 589 days.

(21) Appl. No.: 12/487,512

(22) Filed: Jun. 18, 2009

(65) Prior Publication Data

US 2010/0320665 A1 Dec. 23, 2010

(51) Int. Cl.
*B25B 1/20* (2006.01)

(52) U.S. Cl. ..... 269/38; 269/57; 269/279; 269/289 R; 29/281.1

(58) Field of Classification Search ..... 269/38, 269/57, 279, 289 R, 302.1, 900; 29/281.1
See application file for complete search history.

(56) References Cited

U.S. PATENT DOCUMENTS 2,918,097 A * 12/1959 Thompson ..... 269/38
3,108,792 A * 10/1963 Martin ..... 269/38
3,330,551 A * 7/1967 Bitzenburger ..... 269/38
3,333,842 A * 8/1967 Bitzenburger ..... 269/38
3,338,772 A * 8/1967 McWherter ..... 156/423
4,609,187 A * 9/1986 Fairbanks ..... 269/8
4,749,175 A * 6/1988 Grabits ..... 269/38
4,867,426 A * 9/1989 Mellick ..... 269/38
4,919,405 A * 4/1990 York ..... 269/38
5,061,008 A * 10/1991 Saunders ..... 269/38
5,137,472 A * 8/1992 Hillbish et al. ..... 439/607.32
5,211,382 A * 5/1993 Finlay ..... 269/38
5,987,724 A * 11/1999 Kleman ..... 29/401.1

* cited by examiner

*Primary Examiner* — George Nguyen
(74) *Attorney, Agent, or Firm* — Smith Risley Tempel Santos LLC; Gregory Scott Smith

(57) ABSTRACT

An arrow fletching device with plate clamp, as well as features and aspects thereof, provides an arrow builder the means to accurately and repeatedly position fletching against the shaft of an arrow, without a spring loaded butterfly clamp component, and securely hold the fletching thereto until a bond is attained between the fletching and arrow shaft via an adhesive. Exemplary embodiments of an arrow fletching device with a plate clamp are, generally, jig apparatuses operable to precisely position an arrow shaft relative to an arrow fletching. More particularly, exemplary embodiments of an arrow fletching device comprise a plate component, in lieu of a spring-loaded butterfly clamp, useful for receiving, positioning and retaining fletching against the shaft of an arrow. Advantageously, the use of a plate component with a specifically profiled slot operable to receive and position a fletching reduces the steps required to adhere a fletching to an arrow shaft as well as mitigates the probability of improper installation of the fletching.

17 Claims, 6 Drawing Sheets

ARROW FLETCHING DEVICE WITH PLATE CLAMP

BACKGROUND

An arrow fletching, generally, is a vane-like appendage commonly found affixed, in multiples, to the aft end of an arrow shaft. The purpose of fletching is to stabilize the flight path of the arrow when shot, thereby drastically increasing an archer's accuracy and consistency over that of using an arrow without fletching. While fletching technology has certainly evolved alongside advancements in materials, arrow shaft designs, bow technologies, and so forth, the underlying concept of using a series of fletching to improve arrow flight is nothing new.

Thousands of years before Christ, archers were fashioning bird feathers onto wooden arrow shafts in order to gain consistent arrow flight paths. To facilitate the fashioning, they made use of materials such as sinew, catgut, and strips of hide in order to literally tie the fletching material to the arrow shaft. While today's arrows still exhibit the same time-proven form comprising a shaft with a point on one end and a nock and fletching on the other, modern day archers, of course, don't have to rely on the rudimentary arrow construction techniques employed by their ancestors.

Today's fletching materials of choice vary from real feather to synthetic feather to rubber to plastic. Regardless of the fletching material, however, most arrow fletching or vane designs in use today are simply glued onto an arrow shaft that is made of either aluminum or a carbon composite. In short, beyond materials and construction techniques, the overall design of a fletched arrow has changed very little in tens of thousands of years. So, what's needed in the art? A better technique of construction, that's what.

Arrows, and the fletching in particular, take a beating during use. Each time an arrow is released from a bow, chances are that the fletching will sustain damage from contact with previously shot arrows, targets, tree limbs, or the like. The predictable result of fletching damage is an ongoing expense for the archer. Some archers prefer to buy their arrows from an archery supplier already assembled and ready to be flung. Other archers, perhaps more particular in their preferences or, at least, more fortunate to have abundant time at their disposal, prefer to custom build their arrows. It is these archery enthusiasts, the ones that choose to build their own arrows and/or arrows for other archers, who possess myriad devices and supplies useful for fletching, and re-fletching, arrows.

When constructing an arrow, the positioning of fletching relative to the shaft of an arrow is critical. One simply doesn't squirt some glue down the shaft, stick some fletching on it, and then see how she flies. Rather, a fletching must be precisely positioned and then held in place while the glue dries before the arrow is repositioned for application of the next, precisely positioned fletching.

There are numerous devices known in the art that are useful when fitting an arrow with fletching. Generally, Bitzenburger describes in U.S. Pat. No. 3,330,551, as does Finlay in U.S. Pat. No. 5,211,382, a jig fitted with a spring loaded butterfly style clip that is operable to clamp a fletching and firmly position it relative to an arrow shaft while the fletching glue sets.

Variations of the butterfly clip style fletching jigs taught by Bitzenburger and Finlay are numerous in the market, but all share common shortcomings. For instance, with repeated use, the spring constant associated with the clip portion of jigs known in the art are prone to weakening such that they become unable to consistently grip fletching. Also, when placing a fletching into the spring-loaded clamp, in advance of setting the fletching to the arrow shaft, painstaking care must be taken that the fletching is positioned at the proper depth, angle and index mark within the clamp. Further, the force applied to fletching by way of the clamping force of the clip can damage the fletching as some fletching materials are fragile. Even further, the use of a clamp is generally cumbersome and inconvenient for the user. Moreover, clamp lengths may be specific to fletching lengths and fletching applications and, therefore, expensive clamps often must be swapped out each time a user changes fletching designs.

For all the reasons set forth above, as well as other reasons, prior art in the field of arrow fletching jigs are inadequate. Thus, there is a need in the art for a device operable to consistently and conveniently set arrow fletching without the use of a spring loaded clamp mechanism.

BRIEF SUMMARY

An arrow fletching device with a plate clamp, generally, is a jig apparatus operable to precisely position an arrow shaft relative to an arrow fletching. More particularly, an arrow fletching device such as that disclosed herein employs a plate component, in lieu of a spring-loaded clamp, for receiving, positioning and retaining a fletching against the shaft of an arrow. Advantageously, the use of a plate component with a specifically profiled slot operable to receive and position a specific fletching reduces the steps required to adhere a fletching to an arrow shaft as well as mitigates the probability of improper installation of the fletching.

Modern day fletching applications vary substantially. Common fletching lengths available on the market, for instance, range from one inch to five inches with each length available in myriad combinations of profiles, grain weights, and material choices. Each combination is ideally suited for a specific application such as target shooting with a low energy bow, hunting with a broadhead arrow, competing in an indoor target competition, hunting small game with a blunt tip arrow, etc. The archer's choice of equipment ranging from the bow to the arrow shaft to the arrow tip hardware will necessarily dictate a fletching design for optimum performance.

Consequently, those skilled in the art of arrow building need to be proficient in the application of numerous fletching designs. As has been described, it is common for arrow builders to employ a jig apparatus with a clamp mechanism when seeking to fix a fletching to an arrow shaft. Often, the jig base receives the spring clamp via a magnet feature such that the user may place the fletching into the clamp, taking great care to position the fletching in the proper place within the clamp, and subsequently communicate the clamp with the jig base via the magnetic feature. Assuming that the user is deft at placing the fletching into the spring clamp and communicating the spring clamp to the base jig in just the right position, the fletching will be properly juxtaposed to the waiting arrow shaft.

Various embodiments of an arrow fletching device with a plate clamp seek to minimize the requisite skill a user must possess in order to properly position, align and fix a fletching to an arrow shaft. One exemplary embodiment of an arrow fletching device with a plate clamp comprises a jig base having a means to position an arrow shaft along a plane substantially parallel to, and beneath, a plane defined by its uppermost surface. Further, the base of the exemplary embodiment also comprises a mechanism by which the arrow shaft may be rotated in increments relative to its nock position without causing the arrow shaft to deviate from the aforementioned plane position. Advantageously, the rotational mechanism provides a means by which the arrow may be rotated for subsequent installations of fletching at predetermined increments along the circumference of the arrow shaft.

Importantly, the exemplary embodiment does not require a spring clip component for receiving and positioning fletching, an inadequate aspect of other fletching devices well known in the art. Rather, the exemplary embodiment is operable to securely receive a plate component that communicates in a parallel fashion with the top plane of the uppermost surface of the base jig. Notably, the plate component comprises a slot that is substantially in the center of the plate such that the slot may be positioned over an arrow shaft that has been received by the base jig per the above described functionality. The slot in the plate component is operable to receive a vertically stationed fletching and, when the plate is properly juxtaposed to the uppermost surface of the base jig, repeatedly position the fletching at a predetermined distance from the arrow nock and at a predetermined angle or helical dimension relative to the center line of the arrow shaft.

In the present embodiment, alternative plate components are required for the installation of various fletching designs. The inclusion, or exclusion, of any specific plate design, however, should not be considered a limiting factor for the scope of the invention. Moreover, plate designs may vary according to such factors as the specific fletching being installed, the arrow shaft dimensions, or the desired fletch position and, therefore, plate designs may be novel in and of themselves without limiting the scope of the claims for a fletching apparatus that uses such plates. In fact, it is anticipated that some embodiments of the plate component may be operable to accommodate multiple fletching styles.

A user of an arrow fletching device with a plate clamp, such as the exemplary embodiment being presently described, can apply glue, or some other adhesive, to the base of the fletching such that when the fletching is inserted into the plate component's slot and the plate component is communicated with a base jig that has received an arrow, the fletching is firmly and accurately held in place against the arrow shaft until it is fixed thereto. Once the fletching is secured to the arrow shaft, a user of the embodiment may decouple the plate component from the base jig, thereby simultaneously relieving the fletching from its installed position within the slot. The arrow shaft may then be rotated per the rotational mechanism described above and a new fletching installed in the same manner as the first.

DETAILED DESCRIPTION

Figure 1:
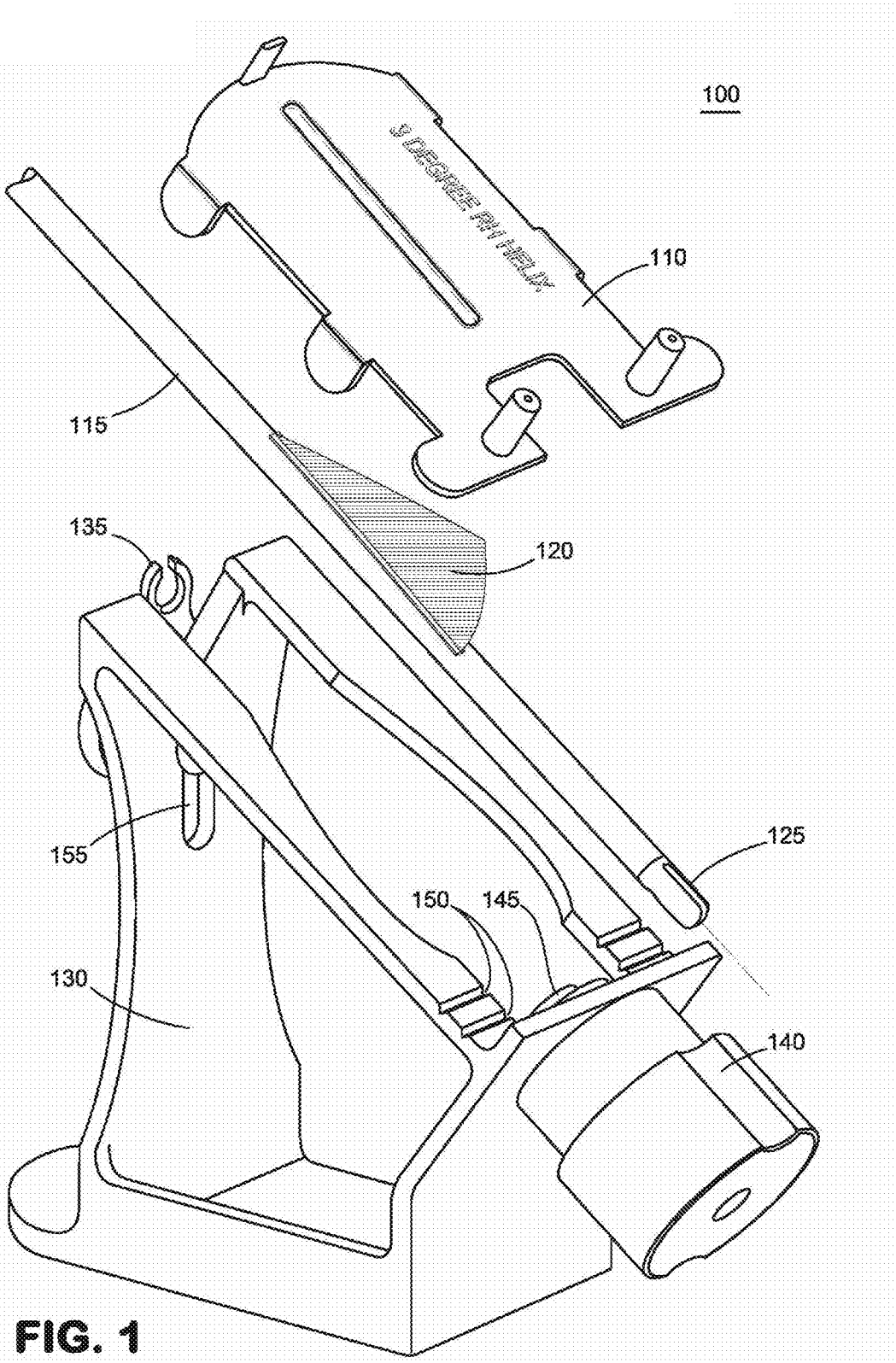
FIG. 1 is an exploded perspective view of an arrow fletching device with a plate clamp shown with an arrow having a nock and a single fletching.

The presently disclosed embodiments, as well as features and aspects thereof, are directed towards providing a device that can accurately and repeatedly position fletching against the shaft of an arrow, without a spring loaded butterfly clamp component, and securely hold the fletching thereto until a bond is attained between the fletching and arrow shaft via an adhesive.

An arrow fletching device with plate clamp, as well as features and aspects thereof, enables an arrow builder to accurately and repeatedly position fletching against the shaft of an arrow, without a spring loaded butterfly clamp component, and securely hold the fletching thereto until a bond is attained between the fletching and arrow shaft via an adhesive. Exemplary embodiments of an arrow fletching device with a plate clamp are, generally, jig apparatuses operable to precisely position an arrow shaft relative to an arrow fletching. More particularly, exemplary embodiments comprise a plate component, in lieu of a spring-loaded butterfly clamp, useful for receiving, positioning and retaining fletching against the shaft of an arrow. Advantageously, the use of a plate component with a specifically profiled slot operable to receive and position a fletching reduces the steps required to adhere a fletching to an arrow shaft as well as mitigates the probability of improper installation of the fletching.

Those skilled in the art of arrow building need to be proficient in the application of numerous fletching designs. As has been described, it is common for arrow builders to employ a jig apparatus with a clamp mechanism when seeking to fix a fletching to an arrow shaft. Often, the jig base receives the spring clamp via a magnet feature such that the user may place the fletching into the clamp, taking great care to position the fletching in the proper place within the clamp, and subsequently communicate the clamp with the jig base via the mechanical coupling feature. Assuming that the user is deft at placing the fletching into the spring clamp and communicating the spring clamp to the base jig in just the right position, the fletching will be properly juxtaposed to the waiting arrow shaft.

Other arrow fletching devices known in the art comprise multiple butterfly clip components sequentially positioned around the shaft of an arrow that has been installed in the device. Advantageously, such prior art provides a means for a user to install multiple fletching simultaneously. Even so, devices comprising multiple butterfly clips for fletching retention still possess the shortfalls of the basic design outlined above. Notably, the exemplary embodiments of an arrow fletching device with plate clamps are offered herein as non-limiting examples and, even though the exemplary embodiments do not explicitly illustrate multiple plate clamps being received by a single jig base, it should be appreciated that such functionality is anticipated.

Various embodiments of an arrow fletching device with a plate clamp seek to minimize the requisite skill a user must possess in order to properly position, align and fix a fletching to an arrow shaft. One exemplary embodiment of an arrow fletching device with a plate clamp comprises a jig base having a means to position an arrow shaft along a plane substantially parallel to, and beneath, a plane defined by its uppermost surface. Further, the base of the exemplary embodiment also comprises a mechanism by which the arrow shaft may be rotated in increments relative to its nock position without causing the arrow shaft to deviate from the aforementioned plane position. Advantageously, the rotational mechanism provides a means by which the arrow may be rotated for subsequent installations of fletching at predetermined increments along the circumference of the arrow shaft.

Importantly, the exemplary embodiment may not require a spring loaded clip component for receiving and positioning fletching, an inadequate aspect of other fletching devices well known in the art. Further, the embodiment may not require the use of magnets, screws, bolting, clips, banding or other means for applying a force to a fletching directed at an arrow shaft. Rather, the exemplary embodiment is operable to securely receive a plate component that communicates in a parallel fashion with the top plane of the uppermost surface of the base jig and is consistently positioned such that a force is applied.

Notably, the plate component comprises a slot that is substantially in the center of the plate such that the slot may be positioned over an arrow shaft that has been received by the base jig per the above described functionality. The slot in the plate component is operable to receive a vertically stationed fletching and, when the plate is properly juxtaposed to the uppermost surface of the base jig, repeatedly position the fletching at a predetermined distance from the arrow nock and at a predetermined angle or helical dimension relative to the center line of the arrow shaft. Further, by virtue of the plate's installed position on the base jig, interference between the base of a stationed fletching and the shaft of an arrow secured within the base jig generates a force useful for encouraging the adhesive properties of any applied glue.

In the present embodiment, alternative plate components are required for the installation of various fletching designs. The inclusion, or exclusion, of any specific plate design, however, should not be considered a limiting factor for the scope of the invention. Moreover, plate designs may vary according to such factors as the specific fletching being installed, the arrow shaft dimensions, or the desired fletch position and, therefore, plate designs may be novel in and of themselves without limiting the scope of the claims for a fletching apparatus that uses such plates.

A user of an arrow fletching device with a plate clamp, such as the exemplary embodiment being presently described, can apply glue, or some other adhesive, to the base of the fletching such that when the fletching is inserted into the plate component's slot and the plate component is communicated with a base jig that has received an arrow, the fletching is firmly and accurately held in place against the arrow shaft until it is fixed thereto. Once the fletching is secured to the arrow shaft, a user of the embodiment may decouple the plate component from the base jig, thereby simultaneously separating the fletching from its installed position within the slot. The arrow shaft may then be rotated per the rotational mechanism described above and a new fletching installed in the same manner as the first.

Turning now to the figures, where like labels represent like elements throughout the drawings, various aspects, features and embodiments of an arrow fletching device with plate clamp will be presented in more detail. The examples as set forth in the drawings and detailed description are provided by way of explanation and are not meant as limitations on the scope of an arrow fletching device with plate clamps. An arrow fletching device with plate clamps thus includes any modifications and variations of the following examples as come within the scope of the appended claims and their equivalents.

FIG. 1 is an exploded perspective view of an arrow fletching device with a plate clamp 100 shown with an arrow 115 having a nock 125 and a single fletching 120. As has been previously described, an arrow fletching device with a plate clamp 100 is generally comprised of a jig base 130 and plate clamp 110. The jig base 130 includes a main base 315, a front wall 325, a rear wall 320 and an upper deck 200 (all illustrated in FIGS. 2 and 3) and is operable to receive and position the shaft of an arrow 115 in a specific plane. In some embodiments, the jig base may comprise a positioning aspect useful for consistently positioning the plate clamp 110 relative to a received arrow 115, such as a series of parallel grooves 150 in the top surface of the upper deck 200. Importantly, the particular embodiment of the jig base component illustrated in the drawings is offered for exemplary purposes only and, therefore, the specific features and aspects associated with the exemplary base should not be interpreted to limit the scope claimed herein. It is anticipated that jig bases of various embodiments of an arrow fletching device with a plate clamp may take on numerous shapes, forms or constructions including, but not limited to, an "I" configuration, a "T configuration, a square, a "C" configuration, a triangle or any other shape useful for providing a stable and operable base.

To receive and position the shaft of an arrow 115 in a specific plane, the jig base 130 comprises a lower receptacle, holder, clamp, clip or other receiving device collectively referred to as a receptacle 145 for receipt of the arrow 115 by the nock 125 as well as an upper receptacle 135 for receipt of the arrow 115 at a point along the shaft. Further, in some embodiments the receptacles that receive the arrow may be adjustable such that the desired plane for arrow shaft positioning may be altered. For instance, the upper and or lower receptacles may be adjusted to change the plane or event the offset of the shaft.

An arrow that has been received by the jig base 130 via its nock 125 is communicatively coupled to a rotational adjustment device 140 such that the arrow shaft 115 may be rotated without deviating from the fixed plane defined by the two receptacles 135, 145. Other features and aspects of the present system will be more specifically described in subsequent drawings.

Figure 2:
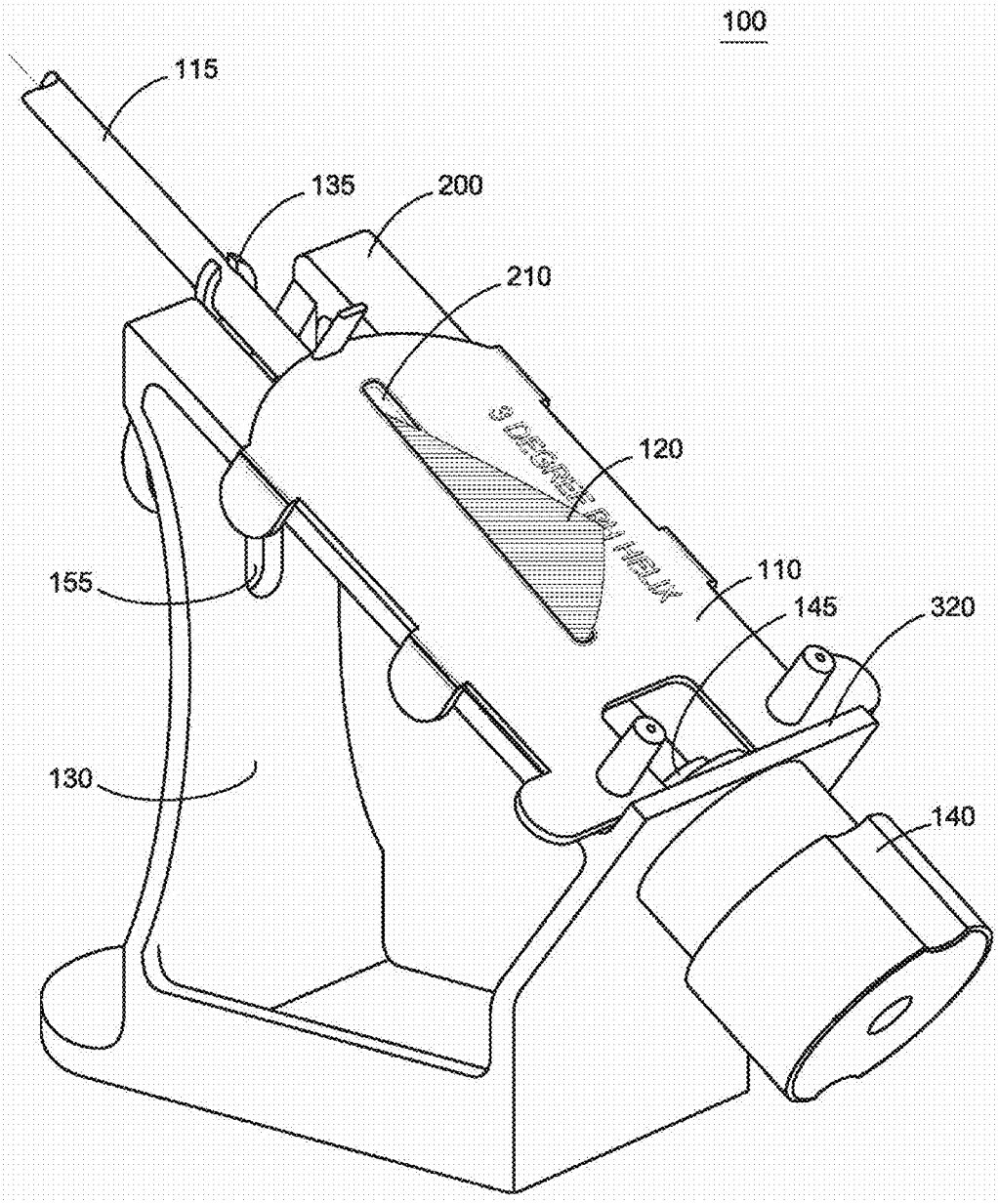
FIG. 2 is a perspective view of an arrow fletching device with a plate clamp shown with a received arrow and fletching.

FIG. 2 is a perspective view of the arrow fletching device with a plate clamp 100 illustrated in FIG. 1, shown with a received arrow 115 and fletching 120. The arrow 115 in FIG. 2 can be seen in a received position such that the shaft of the arrow 115 is in communication with the upper receptacle 135 for securing the arrow 115 at a point along its shaft as well as a lower receptacle 145 for securing the nock 125. Advantageously, once the arrow is in communication with receptacles 135 and 145, the shaft is secured in a plane and may be rotated via an adjustment device 140 without causing the shaft to deviate from the aforementioned plane. The rotational adjustment device 140 depicted in the present embodiment may be operable to consistently index at predetermined rotational angles, such as being gradual or as in a step function or, may be a continuous adjustment with or without position markings. The design of such a rotational adjustment device is well known in the art. Even so, variations of the rotational means are anticipated and it is important to note that while features and aspects of a rotational device may make the device novel in and of itself, the inclusion, or exclusion, of a rotational device within an embodiment of the arrow fletching device with plate clamp should not be construed as a limitation.

Also depicted in FIG. 2, the plate clamp 110 is in receipt of the fletching 120 by way of a slot 210 positioned substantially at its center. Further, the plate clamp 110 is in communication with the jig base 130 such that it resides in parallel with a plane defined by a surface 200 of the jig base 130. Advantageously, when the arrow 115 is in a received position within the base 130, as is shown in FIG. 2, the shaft of the arrow is also positioned substantially in parallel and beneath the planes defined by the jig base surface 200 and plate clamp 110 such that a fletching 120 residing within the plate clamp 110 slot 210 is in communication with the arrow shaft 115 (point of communication not shown in FIG. 2) and oriented in a position that is defined and enforced by the shape and position of the slot 210. In the illustrated embodiment, the slot forces the centerline of the cross-section of the fletching to be substantially perpendicular to the shaft 115.

Figure 3:
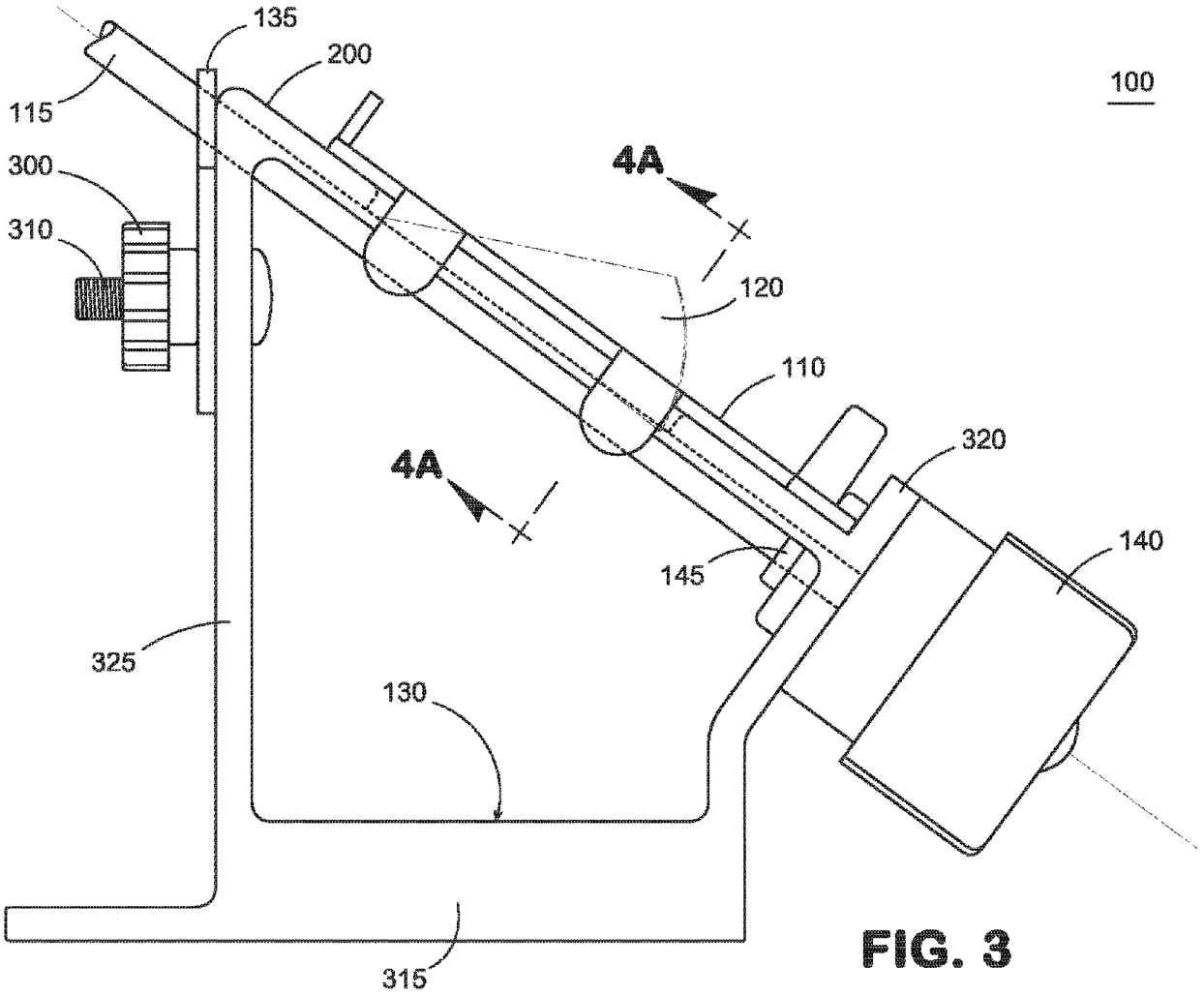
FIG. 3 is a two dimensional side view of an arrow fletching device with a plate clamp shown with a received arrow and fletching.

FIG. 3 is a two dimensional side view of the arrow fletching device with a plate clamp illustrated in FIG. 2, shown with a received arrow and fletching. As described prior, some embodiments of an arrow fletching device with plate clamp 100 comprise means for adjusting the position of the centerline of a received arrow shaft 115. In the exemplary embodiment illustrated in FIG. 3, the arrow is received at its nock 125 by lower receptacle 145 and at a point along its shaft by upper receptacle 135. As shown, upper receptacle 135 is operable to be adjusted vertically (as illustrated or more broadly in a plane with the front wall 325 of the base 130) so that a received arrow 115 may be raised or lowered relative to the plane defined by a surface 200 of the jig base 130.

In the exemplary embodiment, the plane in which the arrow shaft 115 is positioned is adjusted by loosening adjustment nut 300 which is threaded onto a set bolt 310. When the adjustment nut 300 is retracted from a set position, the shaft positioning means 135 may be raised or lowered within a slot 155 in the jig base 130 in a substantially vertical manner such that the shaft of the received arrow 115 is repositioned in a new plane. Advantageously, an arrow 115 may be received while in a plane substantially lower than that defined by surface 200 and then raised and secured via the method previously described to a parallel plane in closer proximity to that defined by surface 200. Once in a parallel plane close to the proximity of that defined by surface 200, the shaft of a received arrow 115 may be communicatively juxtaposed to a fletching 120 that has been received by a plate clamp 110 such that by virtue of the plate's 110 installed position on the jig base 130, interference between the base of the received fletching 120 and the shaft of the arrow 115 generates a force useful for maintaining the position of the fletching 120, relative to the arrow shaft 115, while any applied glue sets.

Notably, the arrow shaft plane adjustment mechanism described herein is offered for exemplary purposes only and should not be considered as a limiting factor for the scope of an arrow fletching device with a plate clamp. It is anticipated that other techniques or mechanisms for adjusting the plane position of a received arrow, novel or otherwise, will be incorporated into various embodiments of an arrow fletching device with plate clamp. For instance, the set bolt 310 depicted in FIG. 3 may be sufficiently short in some embodiments that it would not extend through adjustment nut 300; in such an embodiment, the adjustment nut would not feature a threaded "through hole" but would, instead, feature an adjustment nut capable of internally accommodating the full length of the set bolt. As another example of a potential variation in the plane position adjustment mechanism, some embodiments may comprise a spring loaded configuration such that a threaded set bolt is not required as the adjustment knob may be pulled to relieve a set force and released to apply a set force once the mechanism is positioned. Further, it is also anticipated that some embodiments of an arrow fletching device with plate clamp may not comprise an adjustable aspect for the positioning of an arrow shaft and, accordingly, the presence or absence of such a feature is not limiting for the claimed scope.

Figure 4A:
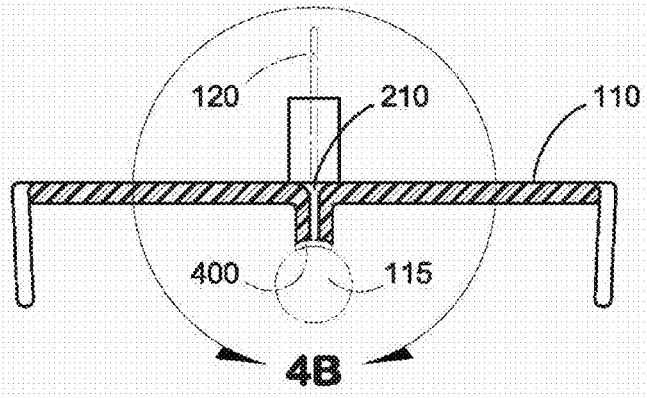
FIG. 4A is a two dimensional cross-section view of a plate clamp component with a received fletching that is in communication with an arrow shaft.

FIG. 4A is a two dimensional cross-section view of an exemplary plate clamp component 110 with a received fletching 120 that is in communication with an arrow shaft 115. As illustrated in FIG. 4, the fletching 120 is in a received position in the slot 210 of the exemplary plate clamp 110. The plate clamp 110 is in communication with a jig base 130 (not shown) such that an arrow 115 received within the jig base 130 is in a plane substantially parallel to that of the communicated plate clamp 110. A typical fletching 120, such as that depicted herein, comprises a fletching base 400 that runs in parallel with the fletching fin, or fletching paddle, and is operable to provide a surface suitable for the receipt of adhesive.

Figure 4B:
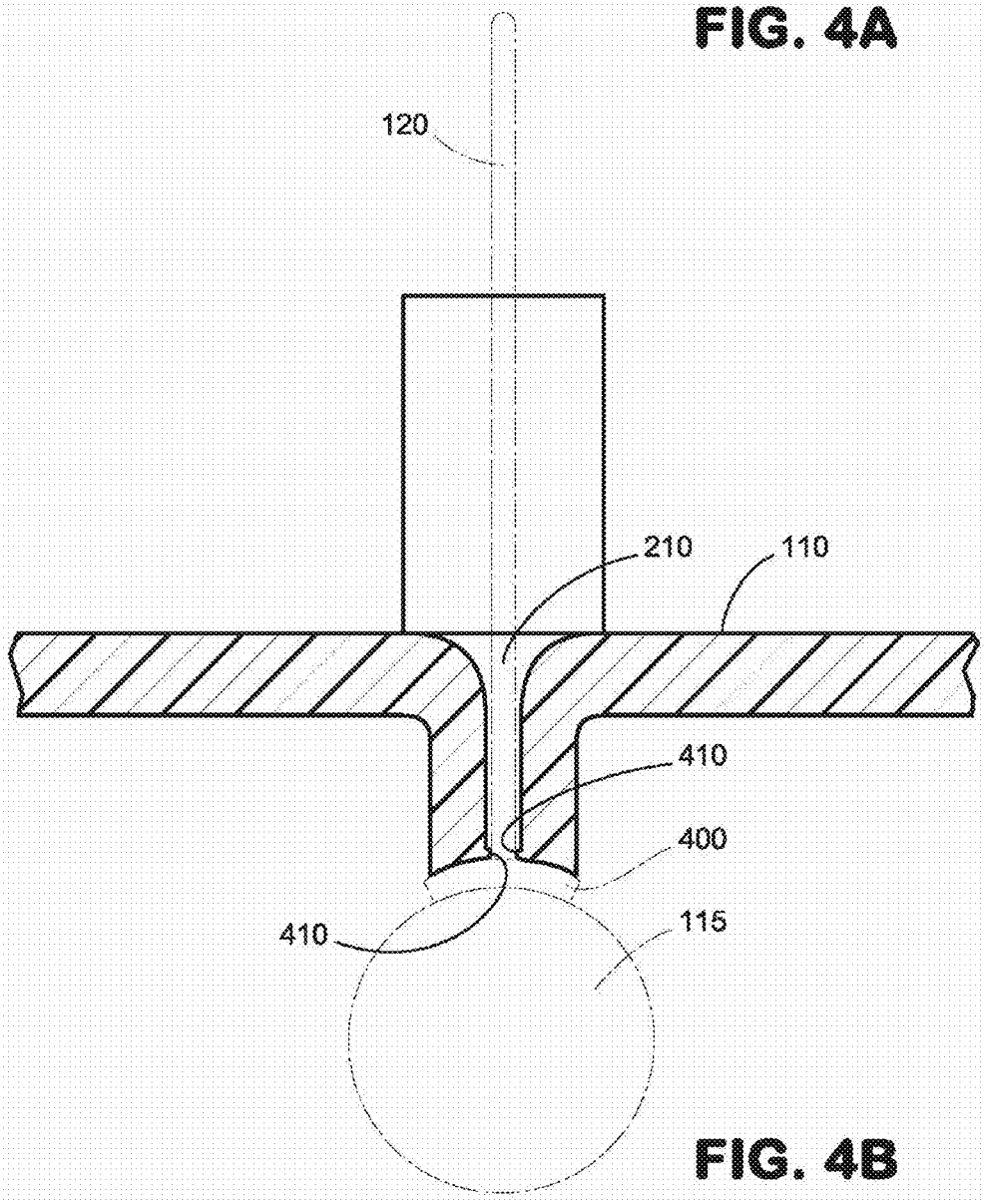
FIG. 4B is an expanded two dimensional cross-section view of a plate clamp component with a received fletching that is in communication with an arrow shaft.

Moving to FIG. 4B, an expanded two dimensional cross-section view is illustrated of an exemplary plate clamp component 110 with a received fletching 120 that is in communication with an arrow shaft 115. The expanded view reveals the additional feature of a fletching retention aspect 410 included in some embodiments of a plate clamp component 110. A fletching retention aspect, such as the "bumps" depicted in FIG. 4B, may be present along the interior surface of the fletching slot 210 in a plate clamp component 110. Advantageously, the inclusion of such an optional aspect operates to provide an amount of resistance against the sides of a received fletching 120 such that the fletching is prevented from inadvertent separation from the plate clamp component 110. Further, as can be best seen in the FIG. 4A and FIG. 4B illustrations, the base 400 of a received fletching is physically juxtaposed to the shaft of a received arrow 115 when the arrow 115 and plate clamp component 110 are fixed in appropriate planes relative to the jig base 130 surface 200.

Figure 5:
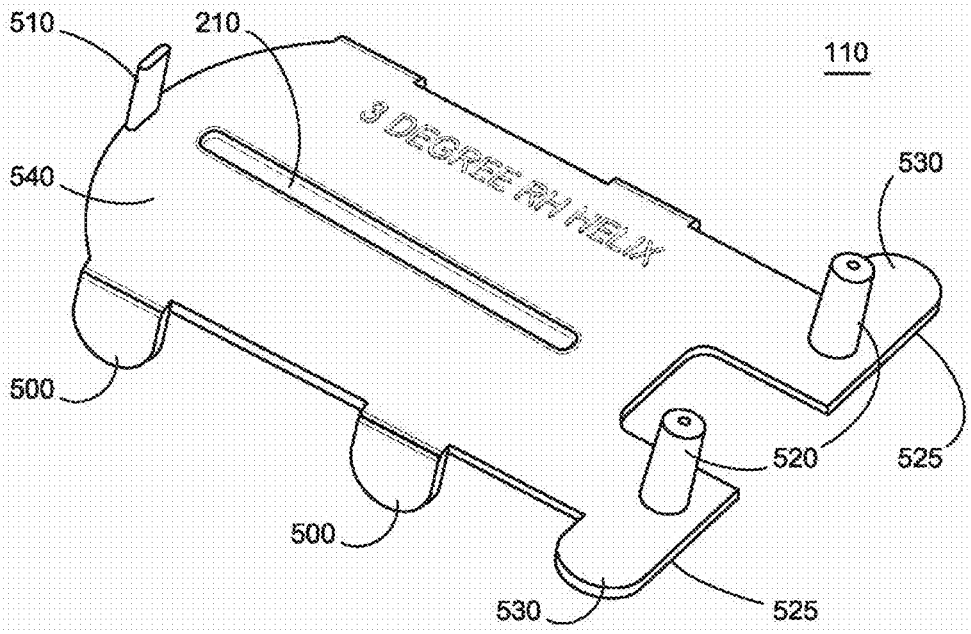
FIG. 5 is a perspective top view of an exemplary plate clamp component operable to communicate with a base jig.

FIG. 5 is a perspective top view of an exemplary plate clamp component 110 operable to communicate with a surface 200 of a base jig 130. The plate clamp component depicted in FIG. 5 is offered herein for exemplary purposes only. All features and aspects of the exemplary embodiment may, or may not, be comprised within all embodiments of a plate clamp component.

Generally, the plate clamp component 110 is comprised of a substantially flat surface 540 having a fletching slot 210 substantially at its center, although the slot can be in a variety of locations relative to the clamp component 110 and the shape and size thereof. As has been described, the fletching slot 210 is operable to receive a fletching and, in some embodiments, may be operable to receive fletching of various designs or constructions. Further, as has been described, the plate clamp component 110, in its various embodiments, is operable to be communicated with a surface, such as surface 200, of a fletching apparatus base jig, such as base jig 130.

Extending downward from the edge of the main surface 540 is a plurality of tabs 500. Advantageously, the tabs 500 operate to create a lateral force against the jig base 130, or may be used to prevent movement, or may be used to secure or connect the clamp component 110 to the jig base 130 when the plate clamp component 110 is in communication with a surface 200 of a jig base 130 such that inadvertent shifting of the communicated plate clamp component 110 is minimized. It will be appreciated that in other embodiments, different techniques may be used to secure the plate clamp component to the jig. For instance, magnets may be used to hold the components in position, as well as clamps, Velcro, or any of a variety of other connection techniques.

Additional features of the exemplary plate clamp component depicted in FIG. 5 include a series of various tabs, in addition to the tabs 500 previously described, with various functions. For example, tab 510 is positioned vertically at the fore end of the plate clamp component 110 and is operable to provide a point at which a user can apply pressure for positioning of the plate clamp component 110 during the process of communication with a jig base 130. Also, vertically positioned tabs 520 at the aft end of the plate clamp component 110 are operable to provide a handle or a force point for placing the plate clamp component 110 onto the base 130. In addition, the vertical tabs 520 and 510 can be used as force points to slide the plate clamp component 110 forward or backward along the surface 200. Advantageously, such movement of the plate clamp component enables the fletching to be installed at different positions along the shaft. A graduated scale, as well as indentions may be used to identify particular settings for the sliding plate clamp component 110. In addition, shims of varying sizes may be used to provide a consistent distance of the plate clamp component 110 from the wall 320.

To clarify, the exemplary plate clamp component 110 depicted in FIG. 5 may be communicated with a jig base 130, presumably after having received a fletching 120 within its slot 210, by the user placing the plate clamp component 110 at an angle above the jig base 130 such that a force is applied to the positioning tab 510 and the butt end 525 of the plate clamp component 110 is in communication with jig base 130 back wall 320. Next, to complete the communication procedure, the user presses the plate clamp component 110 down onto the jig base 130 surface 200 such that it is juxtaposed in a parallel plane to the surface 200. Doing so causes the clamping tabs 500 to flex outward and then retract to grip the edges of the jig base 130 such that the plate clamp component 110 is securely communicated. Advantageously, by positioning the plate clamp component 110 against the back wall 320 with the butt end 525 of the plate clamp component 110, the user may consistently position a received fletching 120 on the shaft of a received arrow 115 relative to the arrow's nock 125. In order to remove or decouple the plate clamp component 110 from the jig base 130, the user may apply an upward force to the underside of the removal tabs 530 extending laterally from the main surface 540 at the aft end of the component 110.

Figure 6A:
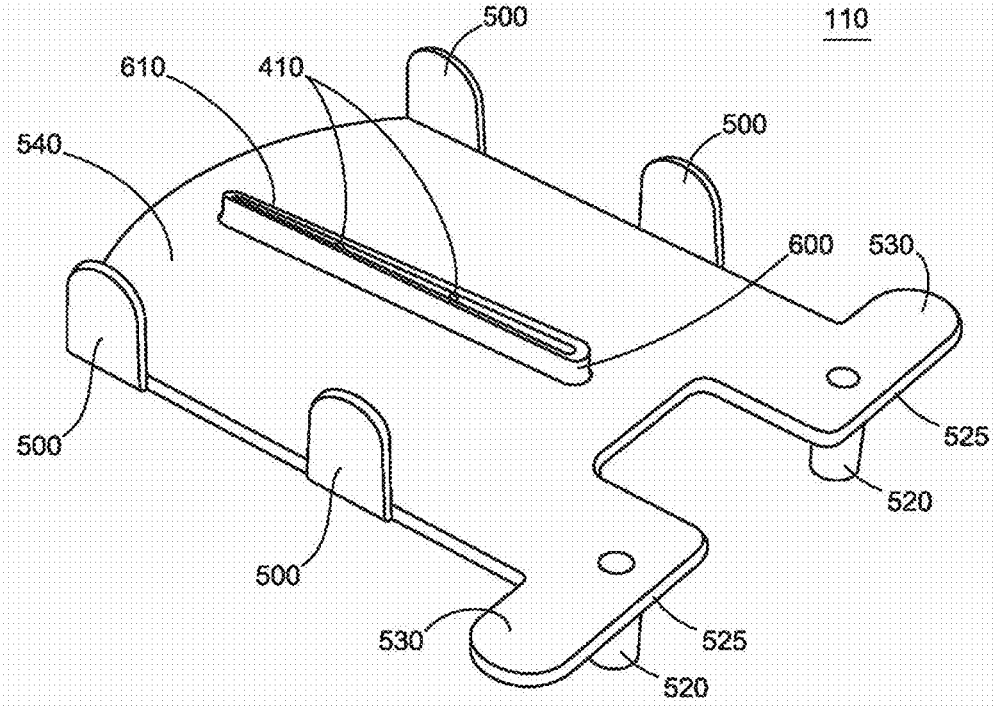
FIG. 6A is a perspective view of the underside of an exemplary plate clamp component illustrating a helical profile on the groove extension.

FIG. 6A is a perspective view of the underside of the exemplary plate clamp component depicted in FIG. 5. All of the features described relative to FIG. 5 can be seen in the FIG. 6A illustration. Additionally, however, it can be seen in FIG. 6A that the underside of the fletching slot 210 in the exemplary embodiment features a slot extension aspect 600. Advantageously, extending the slot at a distance below the underside of the main surface 540 of the plate clamp component 110 operates to position the bottom of the fletching base 400 against the shaft of a received arrow 115 in the jig base 130 (see also FIGS. 4A and 4B) when the plate clamp component is in communication with surface 200.

It should be appreciated that although the plate clamp component is shown as being a separate component from the base, in some embodiments the plate clamp component may actually be integral to the base. Further, in other embodiments the plate clamp component may further include removable slits so that various slit settings can be installed into the plate clamp component.

It can also be seen in FIGS. 5 and 6A, and other figures, that the fletching slot 210 is positioned at an angle relative to the shaft of the received arrow 115. Also, along the bottom most edge of the fletching slot extension 600, it can be seen in FIG. 6A that the exemplary embodiment features a helical contour 610. Advantageously, manipulating the shape of the base 400 of a received fletching 120 at a 3 degree, right-hand offset with a helical twist, and holding such manipulation while the fletching 120 is fixed to the shaft of an arrow 115 via an adhesive or other means, will operate to generate a particular flight path when the arrow is released from a bow. As such, various slit configurations can be used to manipulate the manner in which the fletching is attached and ultimately, how the arrow will fly. For instance, in the illustrated embodiment the fletching configuration may be well suited for an arrow that is fitted with a broadhead and shot from a bow. Importantly, such positioning and shape manipulation of fletching is well known in the art and, although it is foreseeable that new fletching designs and manipulations may provide novel performance, the inclusion, or exclusion, of fletching slots 210 in a plate clamp component 110 operable to provide various fletching manipulations should not limit the scope of an arrow fletching device with plate clamps.

Figure 6B:
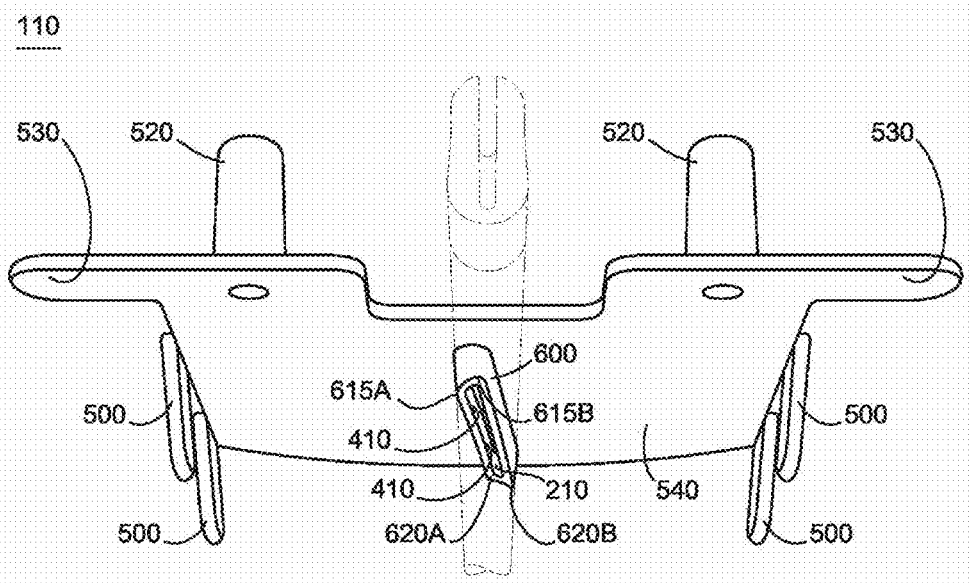
FIG. 6B is also a perspective view of the underside of an exemplary plate clamp component illustrating a helical profile on the grove extension, shown juxtaposed to a phantom arrow shaft.

FIG. 6B is also a perspective view of the underside of an exemplary plate clamp component illustrating a helical profile on the grove extension, shown juxtaposed to a phantom arrow shaft. In the FIG. 6B illustration, the exemplary profile shown depicted on the edge of the fletching slot extension 600 is of a helical design well known in the art. As explained prior, various edge profiles on the edge of the fletching slot extension 600 can be used to manipulate the fletching into a desired shape prior to being fixed to an arrow shaft. Here, the helical profile can be seen such that the higher points 615A, 620B on the profile are catty-cornered from one another and correspond to lower points 615B, 620A at the opposite ends of the profile, respectively. In this way, a "helical twist" is provided such that an inserted fletching is manipulated to conform to the outer diameter of an arrow shaft.

Figure 7:
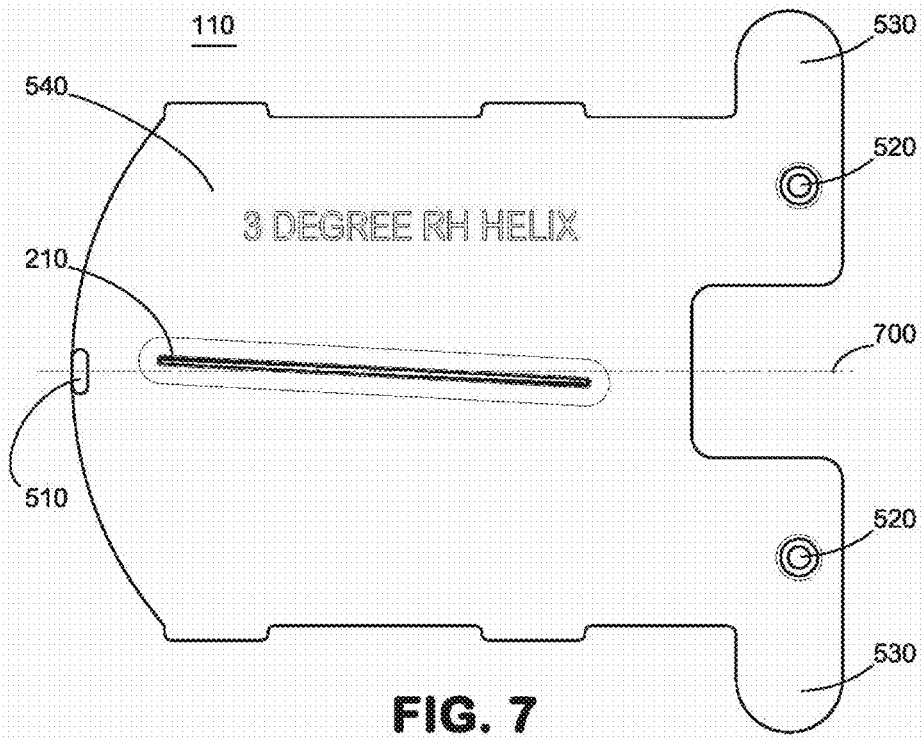
FIG. 7 is a two dimensional top view of an exemplary plate clamp component featuring a 3 degree right hand fletching slot.

FIG. 7 is a two dimensional top view of the exemplary plate clamp component depicted in the foregoing figures. Most of the features described relative to the previous figures can also be seen in the FIG. 7 illustration. From the top view of FIG. 7, however, the 3 degree, right hand angling of the fletching slot 210 can be more easily seen relative to the centerline 700 of the exemplary plate clamp component 110. Again, the manipulation of fletching profiles and angling relative to an arrow shaft is well known in the art and the 3 degree right hand angling depicted in the exemplary embodiment of FIG. 7 is offered for illustrative purposes only. Also well known in the art is 2 degree angling, left hand positioning, no angling, and other fletching manipulations targeted for specific archery applications. Importantly, while the specifications of a physical manipulation of a fletching is not claimed as a limiting aspect of the arrow fletching device with plate clamp presently described, the means of manipulation, i.e. a plate clamp component with a profiled slot aspect, is considered novel and is recited accordingly in the claim set that follows.

It should be appreciated that, in some embodiments, a single plate clamp component may include multiple slits of different configurations. In such embodiments, the base may be adapted to receive the plate clamp in a variety of positions with each position corresponding with one of the multiple slits. In addition, in other embodiments the base may be adapted to receive and hold multiple shafts. In such an embodiment, the plate clamp component may again have multiple slits; however, in this embodiment each slit may correspond with a particular shaft being held in the base. Advantageously, this embodiment would facilitate the build-out of multiple arrows. Even further, some embodiments may utilize a base that holds multiple shafts and a plate clamp component that includes a plurality of slit configurations and that can be installed in the base in a variety of settings. Each such setting would allow a set of the slits to be used for attaching the fletching. In yet another embodiment, the base may hold multiple shafts and the slits in the plate clamp components may be configured in different manners. Thus, a user would use the receptacles in the base that would correspond to the desired fletching characteristics. It should also be appreciated that the various embodiments illustrated may be adapted to automation such that the components can be used in a robotic type machine to install fletching onto shafts.

The present arrow fletching device with plate clamp has been described using detailed descriptions of embodiments thereof that are provided by way of example and are not intended to limit the scope of the device. The described embodiments comprise different features, not all of which are required in all embodiments of an arrow fletching device with plate clamp. Some embodiments of the arrow fletching device with plate clamp utilize only some of the features or possible combinations of the features. Variations of embodiments of an arrow fletching device with plate clamp that are described and embodiments of an arrow fletching device with plate clamp comprising different combinations of features noted in the described embodiments will occur to persons of the art.

It will be appreciated by persons skilled in the art that an arrow fletching device with plate clamp is not limited by what has been particularly shown and described herein above. Rather, the scope of an arrow fletching device with plate clamp is defined by the claims that follow.

What is claimed is:

1. A device for positioning and installing a fletching along a shaft, the device comprising:

a jig base component operable to receive a shaft and maintain said shaft on a particular plane; and a plate component operable to be slideably coupled to the jig base component and comprising a slot having fixed dimensions for receiving a fletching, wherein when the plate component is slideably coupled to the jig base component the slot is parallel to said particular plane such that the base of a fletching received into the slot is held in communication with said shaft received into the jig base component.

2. The device of claim 1, wherein said plate component comprises a series of tabs extending downward in a plane less than or equal to 90 degrees from the plane defined by its top surface.

3. The device of claim 2, wherein said tabs are operable to interfere with said jig base component when said plate component is in communication with said jig base component such that said plate component is prevented from inadvertent repositioning.

4. The device of claim 1, wherein, via a magnetic force, said plate component is prevented from inadvertent repositioning when in communication with said jig base component.

5. The device of claim 1, wherein said jig includes an upper receptacle and a lower receptacle for receiving the shaft, the upper receptacle and the lower receptacle cooperating to define the particular plane.

6. The device of claim 5, wherein at least one of the upper receptacle and the lower receptacle of said jig base component can be adjusted thereby defining a different plane.

7. The device of claim 6, wherein jig base component further comprises:

a front wall; and wherein said upper receptacle is slideably mounted to said front wall to allow the upper receptacle to be adjusted thereby modifying the plane at which the shaft is maintained.

8. An apparatus to facilitate the positioning and attachment of fletching along an arrow shaft, the apparatus comprising:

a jig base component operable to receive an arrow shaft and securely position said arrow shaft on a particular plane, wherein the arrow shaft may be mechanically received by a lower receptacle receiving a first end of the shaft and an upper receptacle receiving the shaft at a point along the shaft distal from the first end;

at least one plate component defining a slot for receiving a fletching and being operable to slideably couple to said jig base component such that the base of a received fletching may be positioned along a plane parallel to said plane upon which said shaft is secured; and a rotatable component that is integral with the lower receptacle such that when the rotatable component is rotated, the lower receptacle also rotates thereby causing said received shaft to also rotate without causing the shaft to substantially deviate from the particular plane.

9. The apparatus of claim 8, wherein the rotatable component is operable to be turned in set increments.

10. The apparatus of claim 8, wherein the upper receptacle and the lower receptacle can be adjusted relative to each other to modify the plane upon which a shaft is secured.

11. An apparatus to facilitate the attachment of a fletching to a shaft when the shaft has been secured in a position relative to a plane of the apparatus, the apparatus defining at least one slot operable to receive a fletching, hold the fletching in a particular configuration and press the base of the fletching against the shaft, wherein the at least one slot further comprises a fletching retention aspect along the interior surface of said slot such that an amount of resistance against the sides of a received fletching is provided to hold the fletching in a position within the at least one slot.

12. The apparatus of claim 11, further defining an extension towards the shaft that further defines the slot.

13. The apparatus of claim 12, wherein the edge of the extension nearest the shaft is contoured.

14. A system to facilitate the mounting of fletching to a shaft, the system comprising:

a jig base having a front wall, a base, an upper deck and a rear wall;

an upper receptacle adjustably mounted to the front wall and operative to receive a portion of the shaft;

a lower receptacle rotatably mounted to the rear wall and integral to a rotation component; and a plate defining a slot for receiving a fletching, the slot being structured so as to force the fletching into a desired orientation relative to the shaft when the plate is positioned on the upper deck of the jig base.

15. The system of claim 14, further comprising a plurality of plates that can be mounted to the upper deck of the jig base with each of the plurality of plates defining a slot configured to force the fletching into a different orientation relative to the shaft.

16. The system of claim 14, wherein the plate further comprises a series of tabs extending downward in a plane less than or equal to 90 degrees from the plane defined by its top surface and that are operable to engage the upper deck of the jig base.

17. The system of claim 14, wherein the lower receptacle is such that when the integrated rotation component is rotated, the shaft is also rotated.

* * * * *